US006289532B1

(12) United States Patent
Fritz et al.

(10) Patent No.: US 6,289,532 B1
(45) Date of Patent: Sep. 18, 2001

(54) TUB OVERFLOW WASTE ASSEMBLY

(75) Inventors: Kurt M. Fritz; Ted D. Deeds; Samuel H. Howe, all of Carson City, NV (US)

(73) Assignee: LSP Products Group, Inc., Carson City, NV (US)

( * ) Notice: Subject to any disclaimer, the term of this patent is extended or adjusted under 35 U.S.C. 154(b) by 0 days.

(21) Appl. No.: 09/662,928

(22) Filed: Sep. 15, 2000

Related U.S. Application Data

(63) Continuation-in-part of application No. 09/452,597, filed on Dec. 1, 1999, now Pat. No. 6,192,531.

(51) Int. Cl.[7] ..... E03C 1/12

(52) U.S. Cl. ..... 4/679; 4/680; 4/694; 138/90; 73/49.8; 285/46; 285/206

(58) Field of Search ..... 4/417, 420, 541.6, 4/538, 584, 679–695; 137/797; 138/90; 73/49.1, 49.8; 285/46, 206, 208; 210/248, 294, 320

(56) References Cited

U.S. PATENT DOCUMENTS

| | | | |
|---|---|---|---|
| 1,010,469 | 12/1911 | Weaver . | |
| 1,781,719 | 11/1930 | Darling . | |
| 2,052,565 | 9/1936 | Groeniger | 4/199 |
| 2,223,365 | 12/1940 | Groeniger | 4/199 |
| 2,243,204 | 5/1941 | Groeniger | 4/199 |
| 4,006,498 | 2/1977 | Cuschera | 4/191 |
| 4,763,510 | 8/1988 | Palmer | 73/40.5 |
| 5,025,509 | 6/1991 | Holt et al. | 4/206 |
| 5,507,501 | 4/1996 | Palmer | 277/9 |
| 5,890,241 | 4/1999 | Ball | 4/538 |
| 6,192,531 * | 2/2001 | Fritz et al. | 4/679 |
| 6,209,584 * | 4/2001 | Huber | 138/89 |

* cited by examiner

*Primary Examiner*—Gregory L. Huson
*Assistant Examiner*—Tuan Nguyen
(74) *Attorney, Agent, or Firm*—Locke Liddell & Sapp LLP; Monty L. Ross

(57) ABSTRACT

A tub waste overflow assembly that is attachable to a tub wall by means of a threaded retaining body insertable through an overflow drain aperture in a tub wall to engage a cooperatively threaded pipe fitting on the opposite side of the tub wall. A chamfered washer is provided to cooperate with the retaining body and an annular sealing gasket to produce a fluid-tight seal on the interior surface of the tub wall. A forwardly projecting fulcrum member on the pipe fitting preferably contacts the exterior tub wall outwardly of the aperture to facilitate connection of a drain pipe to tub walls over a range of included angles, and no seal is required around the overflow drain aperture on the exterior tub wall. A unitarily molded, knock-out test plug is provided across the bore of the retaining body and a handle desirably attached to the test plug projects into the tub to facilitate installation.

27 Claims, 3 Drawing Sheets

TUB OVERFLOW WASTE ASSEMBLY

CROSS-REFERENCE TO RELATED APPLICATIONS

This application is a continuation-in-part of U.S. application Ser. No. 09/452,597, filed Dec. 1, 1999 now U.S. Pat. No. 6,192,531.

BACKGROUND OF THE INVENTION

1. Field of the Invention

This invention relates to overflow waste assemblies for tubs such as bathtubs and spas, and more particularly, to an overflow waste assembly utilizing a screw-in retaining body in combination with an elbow fitting having at least one fulcrum member permitting engagement with a tub wall at various angles and an annular gasket providing a reliable, water-tight seal on the tub interior without an exterior tub gasket. This invention also relates to an overflow waste assembly having a polymeric screw-in retaining body with a removable, integrally molded test plug and attached handle member.

2. Description of Related Art

The use of waste water overflow drains in tubs such as bathtubs and spas is well known. Such overflow drains are typically located at or near the maximum intended fill level of the tub and in proximity to plumbing connecting the main tub drain to a sewer line. Prior art fittings for tub waste overflows are disclosed, for example, in the following U.S. Pat. Nos. 1,010,469; 1,781,719; 2,052,565; 2,223,365; 2,243,204; and 5,890,241. Test plugs for hydraulic testing of plumbing systems are disclosed, for example, in U.S. Pat. Nos. 4,763,510; 5,507,501 and 5,890,241.

Tub waste overflows usually comprise some type of fitting that connects a portion of the fitting on the inside of the tub to a drain line disposed behind the tub wall. A cover plate having recesses that admit water but not foreign objects into the drain system is generally provided on the inside of the tub. Sealing gaskets are desirably utilized on both sides of the tub wall to prevent water from leaking around the fitting. Because tub wall angles can vary significantly, tub waste overflow assemblies are desirably adaptable to provide a water-tight connection when installed in tubs having different wall angles, preferably while maintaining a substantially vertical waste drop. Tub waste overflow assemblies should also be capable of being hydraulically tested following installation without having to break the tub seal.

In applicant's prior, copending application Ser. No. 09/452,597, filed Dec. 1, 1999, incorporated by reference herein, a tub waste overflow assembly is disclosed that is attachable to a tub wall by means of a threaded retaining body insertable through an overflow drain aperture in a tub wall to engage a cooperatively threaded pipe fitting on the opposite side of the tub wall. A chamfered washer is provided to cooperate with the retaining body and an annular sealing gasket to produce a fluid-tight seal on the interior surface of the tub wall and frictionally engage a cover member spanning the overflow drain aperture. Optionally, a removable test plug is molded in place across the mouth of the retaining body to facilitate hydraulic testing following installation. While this apparatus represents a significant and valuable improvement over prior art devices, there remains a need for a tub overflow waste assembly that does not require the use of an exterior tub gasket to accommodate various tub and elbow angles, and that does not require the use of tools to install the waste assembly on the tub. Such an apparatus is disclosed herein.

SUMMARY OF THE INVENTION

A tub waste overflow assembly is disclosed herein that is attachable to a tub wall by means of a threaded retaining body insertable through an overflow drain aperture in a tub wall to engage a cooperatively threaded pipe fitting on the opposite side of the tub wall. According to one preferred embodiment of the invention, a retaining body having an externally threaded end is insertable through a tub overflow waste hole, and is cooperatively alignable with the female end of an oppositely disposed drain pipe fitting outside the tub. A forwardly facing annular flange on the cylindrical retaining body compresses a sealing gasket and washer against the interior tub wall, thereby eliminating the need for a rear tub seal. A fulcrum member is desirably provided on the back side of the tub wall between the tub wall and a facing annular flange on the drain pipe fitting to facilitate connection with the retaining body over a range of angular relationships between the tub wall and the assembled elbow and retaining body. The retaining body preferably has an annular recess disposed between the threads and flange for seating a sealing ring preventing leakage between the drain pipe fitting and the retaining body behind the tub wall.

The internal bore of the retaining body preferably has an integral test plug with an attached handle member having wings projecting toward the tub interior. The wings are useful for manually threading the retaining body into the elbow and for tightening the retaining body and gasket against the tub wall without the need for tools. The test plug and handle member can be removed by knocking them out of the retaining body bore following installation and pressure testing.

According to another embodiment of the invention, a tub waste overflow assembly is provided having a pipe fitting with female threads on the end adjacent the tub and a forwardly facing annular flange with at least one fulcrum member. The fulcrum member contacts the exterior tub wall adjacent to the waste hole and facilitates attachment of the assembly to tub walls over a range of angles between the flange and tub wall without the need for a gasket on the exterior of the tub wall. Most preferably, the forwardly facing annular flange comprises two diametrically opposed fulcrum members projecting outwardly toward the tub. The fitting is most preferably an 83° molded plastic elbow attached to a drain pipe and having female threads on the end nearest the tub, although other fittings and elbows with other included angles can also be used within the scope of the invention. An externally threaded retaining body attachable to the pipe fitting, a chamfered washer, and an annular sealing gasket are preferably provided to produce a fluid-tight seal on the interior surface of the tub wall when the retaining body is inserted partially through the tub waste hole from the inside of the tub, and threaded into engagement with the pipe fitting behind the tub wall. An o-ring seal is preferably provided between the outside surface of the retaining body, forwardly of the threaded section, and the interior of the elbow to prevent any fluid leaking past the threads from wetting the space behind the tub wall.

According to another preferred embodiment of the invention, a removable test plug is molded in place across the mouth of the retaining body to facilitate hydraulic testing following installation, and a molded plastic handle member is attached to the test plug, preferably unitarily molded with the test plug, to facilitate installation of the tub overflow waste assembly without tools. Following hydraulic testing, the test plug and handle member are removable by the application of sufficient force to the handle member to rupture an annular web connecting the test plug to the remainder of the retaining body. Following removal of the test plug and handle member, a cover can be placed over the assembly and attached by any suitable means such as fasteners, biasing members, frictional engagement, and the like.

This apparatus represents a significant and valuable improvement over prior art devices that require the use of an exterior tub gasket to accommodate various tub and elbow angles, and that require the use of tools to install the waste assembly on the tub.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENTS

Figure 1:
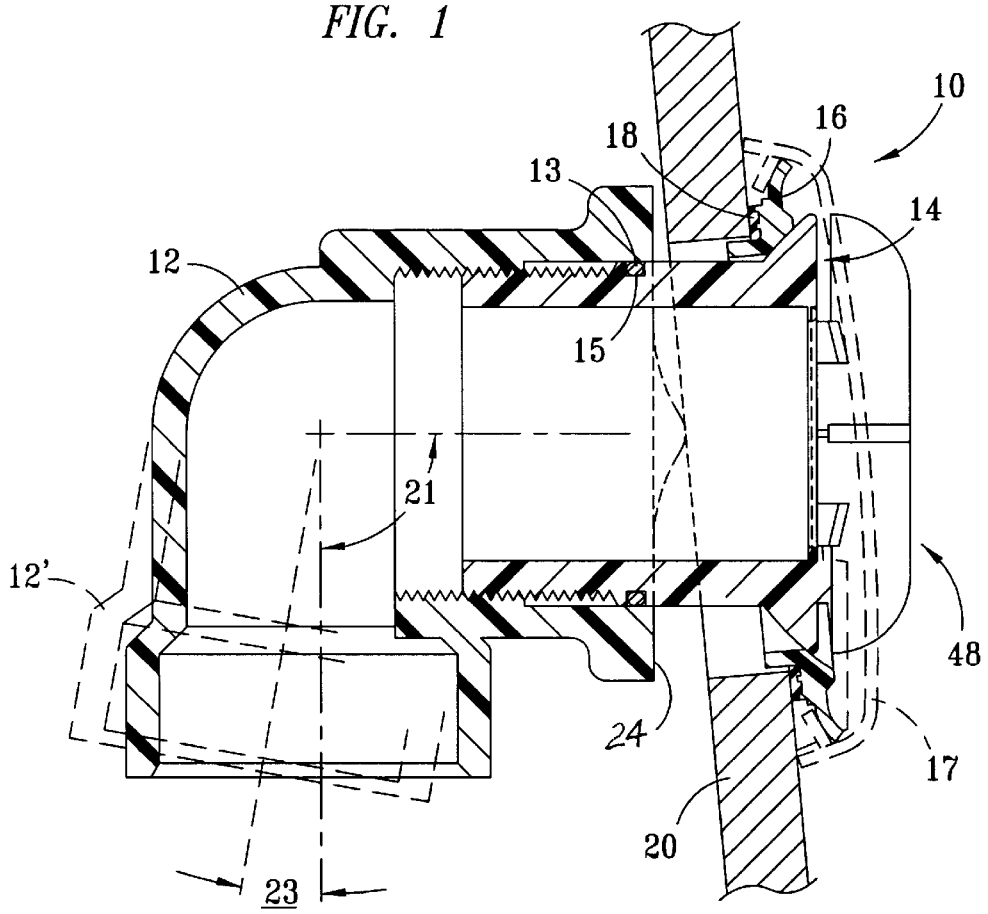
FIG. 1 is a simplified, cross-sectional, front elevation view of a preferred embodiment of the tub overflow waste assembly of the invention as installed in the waste hole of a tub wall.
Figure 2:
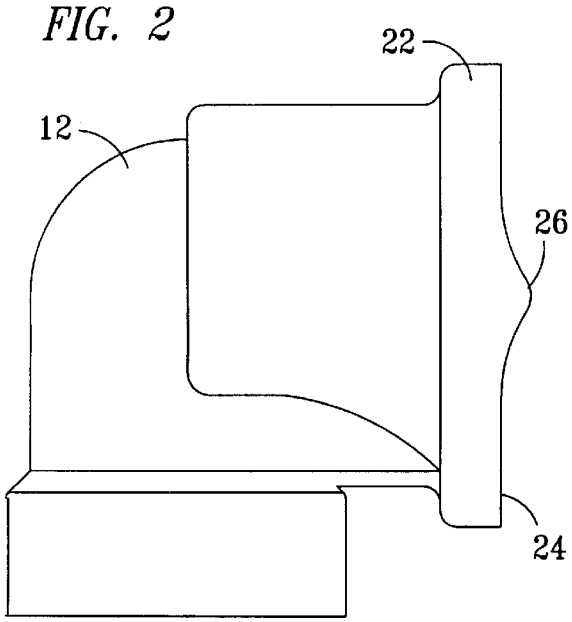
FIG. 2 is a front elevation view of the elbow portion of the tub overflow waste assembly of the invention as shown in FIG. 1, showing one of the projecting fulcrum members on the flange face.
Figure 3:
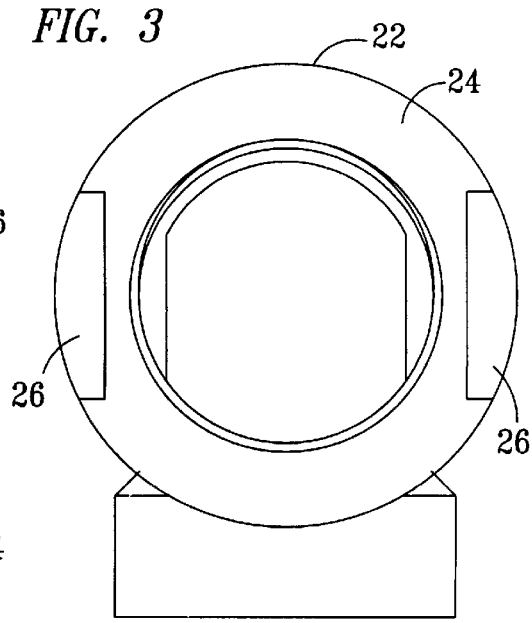
FIG. 3 is a side elevation view of the elbow shown in FIG. 2, showing two diametrically opposed pivot fulcrum projections on the flange face.

Referring to FIGS. 1 and 2, tub overflow waste assembly 10 of the invention preferably comprises retaining body 14, chamfered washer 16 and tub gasket 18. Retaining body 14 is preferably adapted for insertion through aperture 28 in tub wall 20 and for threaded engagement with internally threaded female end 38 of a drain pipe coupling such as elbow 12 disposed behind tub wall 20.

Figure 4:
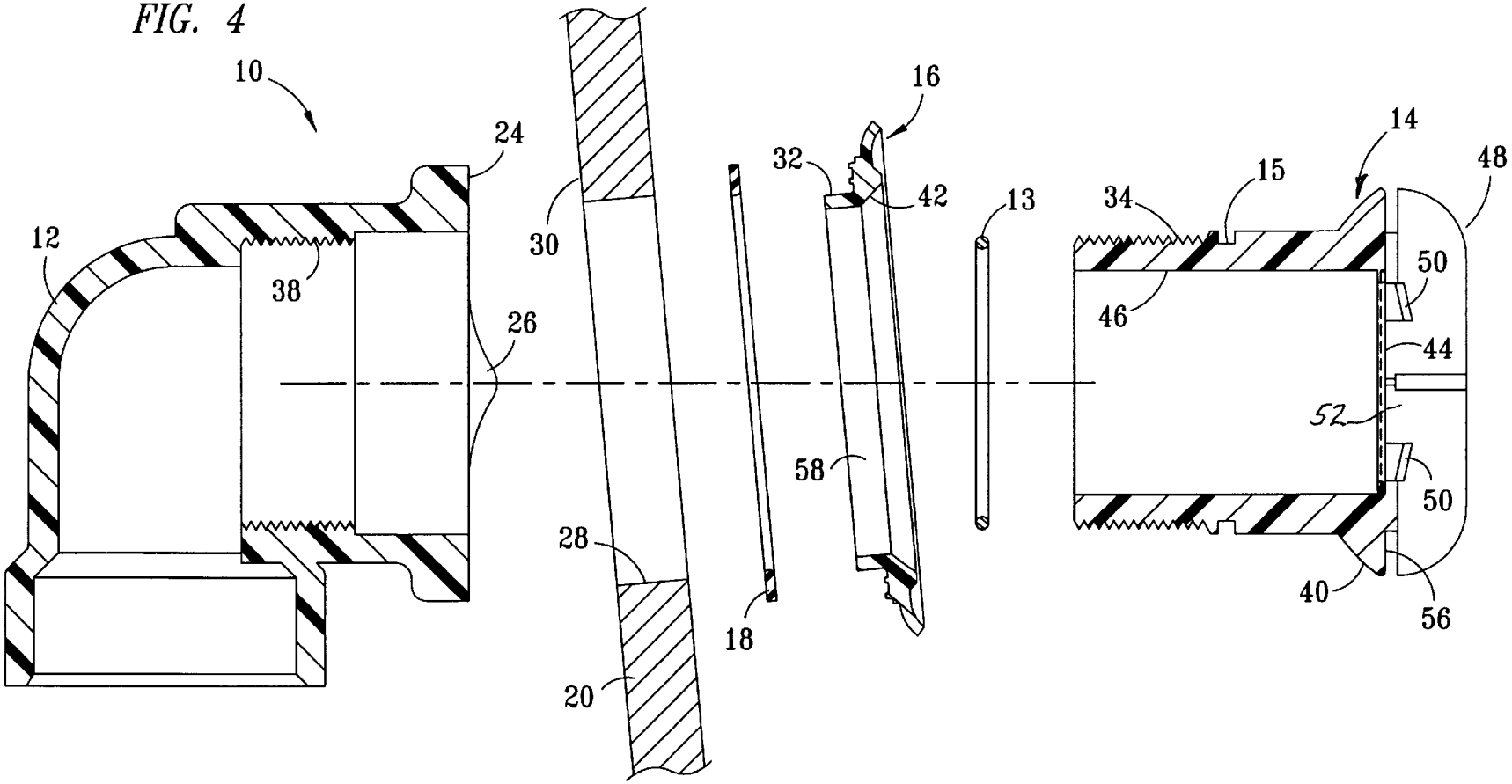
FIG. 4 is an exploded view of the installed tub overflow waste assembly of FIG. 1.
Figure 6:
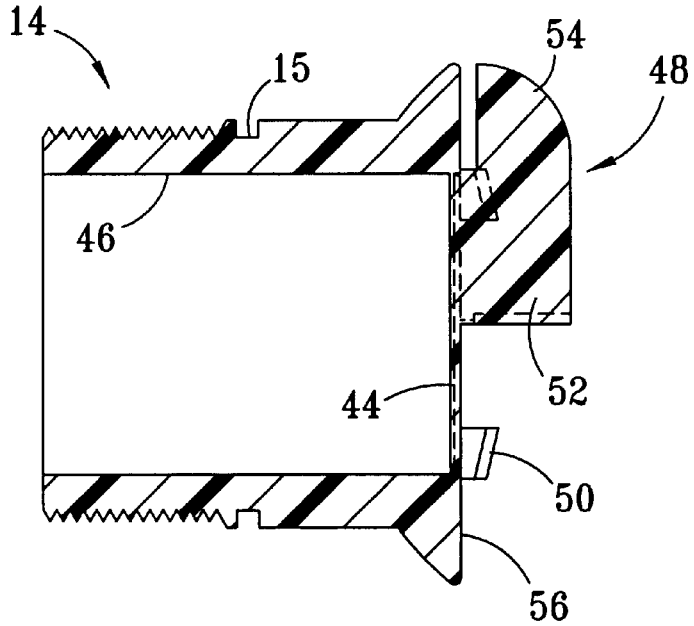
FIG. 6 is a cross-sectional elevation view taken along line 6—6 of FIG. 5.

Referring to FIGS. 1–4, elbow 12 is preferably a molded plastic article having two substantially transverse internal bore sections with center lines intersecting at an angle 21 ranging from about 83° to about 90°. Referring to FIGS. 1, 4 and 6, retaining body 14 preferably comprises a substantially cylindrical bore 46, an externally threaded section 34, an annular flange having inclined surface 40 and forwardly facing surface 56, and a plurality of circumferentially spaced, forwardly projecting lugs 50. Annular recess 15 is desirably provided between externally threaded section 34 and the annular flange of retaining body 14 to seat a sealing ring 13, most preferably an elastomeric o-ring, that seals against the interior of elbow 12 to prevent any water that might leak past threaded section 34 into the space behind the tub. Although retaining body 14 can be made of metal, it is preferably made of a durable polymeric material such as acrylonitrile butadiene styrene terpolymer ("ABS"). According to a particularly preferred embodiment of the invention, retaining body 14 is made of a moldable polymeric resin, and further comprises a relatively thin, disk-shaped, knock-out test plug 44 traversing axial bore 46. Test plug 44 is either unitarily molded in place or otherwise provided interiorly of forwardly facing surface 56 to facilitate hydraulic testing. Handle member 48 is desirably attached to test plug 44 and projects forwardly toward the tub interior. Handle member 48 permits retaining body 14 to be installed in aperture 28 of tub 20 without tools. The thickness of test plug 44 is preferably adequate to resist the torque required to thread retaining body 14 into elbow 12 and to resist rupture when exposed to the hydraulic pressures encountered during leak testing but susceptible to being removed following such testing. Although not shown in the drawing, a beveled recess can be provided around the edges of test plug 44 to weaken the edges of the plug and facilitate its removal. Following installation and hydraulic testing, test plug 44 and handle member 48 can be removed by the application of force to handle member 48.

Figure 5:
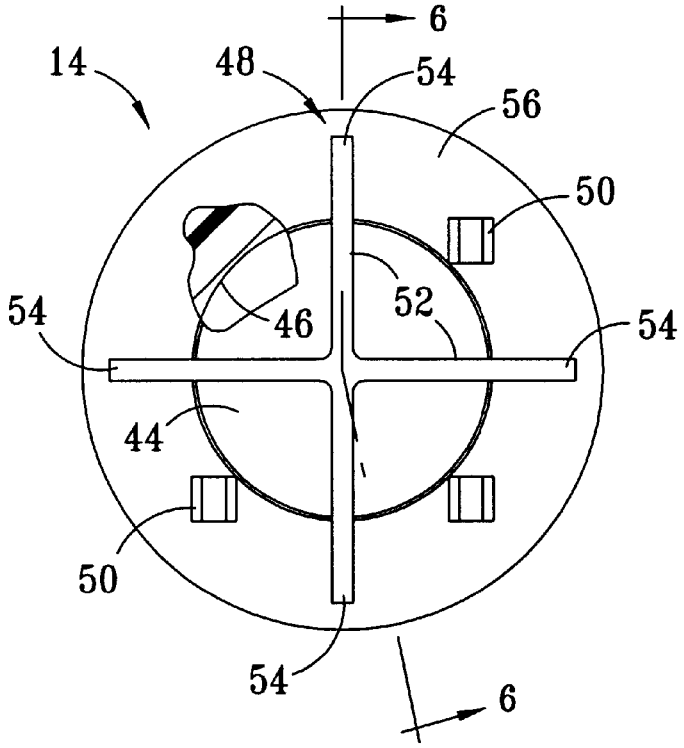
FIG. 5 is a side elevation view of the retaining body of FIGS. 1 and 4.

Referring to FIGS. 5 and 6, handle member 48 preferably comprises stem portion 52 projecting forwardly from test plug 44 and wing members 54 projecting radially outward from the stem portion 52. Wing members 54 can be easily grasped by the user when threading retaining body 14 into elbow 12 during installation (FIGS. 1 and 4). While the structure shown in the drawings is preferred, it should be understood that the configuration of handle member 48 can vary within the scope of the invention so long as the handle is easily graspable by the user and is attached to test plug 44 in such manner that more force is required to detach handle member 48 from test plug 44 than is required to detach test plug 44 from the remainder of retaining body 14. Thus, for example, stem 52 can comprise a forwardly projecting cylindrical wall attached to test plug 44 and wings 54 can project radially outward from the cylindrical wall. Where retaining body 14 is molded from a polymeric resin, mold design considerations will necessarily affect the preferred configuration of handle member 48.

Test plug 44 and handle member 48 can be unitarily molded together with the remainder of retaining body 14, or retaining body 14 can be molded in parts that are then attached by other similarly effective means such as sonic welding, spin welding, solvent based adhesives, or the like. Circumferentially spaced, forwardly projecting lugs 50 are desirably provided on flange surface 56 for use in threading or unthreading retaining body 14 from elbow 12 following the removal of test plug 44 and handle member 48. It should be understood that lugs 50 can likewise be located at other positions on surface 56 within the scope of the invention.

Referring again to FIGS. 1 and 4, during installation of tub overflow waste assembly 10 on tub wall 20, the externally threaded end of retaining body 14 is inserted through chamfered washer 16 and interior tub gasket 18, then through aperture 28 in tub wall 20 and into threaded engagement with female threads 38 of elbow 12. Handle member 48 on retaining body 14 is useful for rotating retaining body 14 relative to elbow 12 during tightening of assembly 10. Threaded section 34 of retaining body 14 will desirably engage threads 38 of elbow 12 sufficiently that o-ring 13 in annular recess 15 engages the smooth interior flange portion of elbow 12.

As retaining body 14 is threaded into elbow 26, inclined annular flange surface 40 of retaining body 14 desirably contacts and abuts against correspondingly inclined, chamfered annular surface 42 of washer 16. Chamfered washer 16 is preferably made of polypropylene or any other similarly useful, durable polymeric material and further comprises a substantially cylindrical collar section 58 adjacent to annular surface 42. The inside diameter of cylindrical collar section 58 is desirably slightly greater than the outside diameter of male threaded section 34 of retaining body 14 to permit threaded section 34 to extend through it in a closely fitting relationship whenever inclined annular surface 40 of retaining body 14 is fully seated against inclined annular surface 42 during tightening. Chamfered washer 16 preferably has a stepped outside wall having an outside diameter greater than the diameter of aperture 28 through tub wall 20, and a recessed cylinder wall 32 having a diameter slightly less than the diameter of aperture 28. Recessed cylinder wall 32 locates chamfered washer 16 in aperture 28. The annular flange shoulder extending radially outward from wall 32 is preferably sufficiently wide to overlap the interior surface of tub wall 20 around aperture 28 and provide sufficient surface area contacting interior tub gasket 18 to produce a fluid-tight seal relative to aperture 28 whenever retaining body 14 is tightened relative to elbow 12. Interior tub gasket 18 is preferably made of rubber, such as ethylene propylene diamine rubber (EPDM), or any other compressible material that is similarly useful as a gasket between retaining body 14 and the interior surface of tub wall 20. If desired, following removal of test plug 44 and handle member 48, cover 17, shown in phantom outline in FIG. 1, made of metal or plastic can be attached by frictional engagement at locations spaced around the perimeter of washer 16, or otherwise, over the open end of retaining body 14. Such a cover will have slots or the like permitting water to flow past the cover and into retaining body 14 and drain pipe elbow 12.

In the past, relatively thick, elastomeric sealing rings have been provided around the waste hole on the outside of tub walls to facilitate attachment of a drain pipe fitting and/or to provide a fluid-tight seal. Such "back-side" gaskets were often needed to adjust for variations in the included angle between the annular face of the elbow or other drain pipe fitting and the tub wall. Such angular variations can be caused by different slopes in the tub wall, by the use of elbows having slightly different angles, or by drain pipes installed at slightly irregular angles. According to one embodiment of the invention disclosed herein, as described in relation to FIGS. 1–4, elbow 12 preferably comprises at least one fulcrum member 26, most preferably having a curvilinear surface, projecting outwardly from the forwardly facing surface 24 of annular flange 22. According to a particularly preferred embodiment of the invention, two diametrically opposed, elongated, curvilinear fulcrum members 26 are disposed on face 24 of annular flange 22. When elbow is molded from a polymeric material, fulcrum members 26 can be unitarily molded onto the face of the flange. Fulcrum members 26 are desirably positioned so as to make abutting contact with that portion of outside surface 30 of tub 20 that is adjacent to aperture 28 so that elbow 12 can be pivoted on fulcrum members 26 relative to tub 20, varying angle 23 to facilitate the alignment of internal threads 38 of elbow 12 with external threads 34 of retaining body 14. It will also be appreciated by those of ordinary skill in the art upon reading this disclosure that other similarly effective means can be provided within the scope of the invention to function as a fulcrum member between elbow 12 and tub 20.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

What is claimed is:

1. A tub overflow waste assembly attachable to a tub wall through an aperture in the tub wall, the assembly comprising;

a retaining body insertable through the aperture, the retaining body having an axial bore with external threads and a first annular flange disposed inwardly of the tub wall;

a drain pipe fitting disposed outwardly of the tub wall, the fitting having internal threads cooperatively aligned and reversibly engageable with the external threads of the retaining body, and a second annular flange facing the tub wall around the aperture;

at least one fulcrum member projecting forwardly of the second annular flange to contact the tub wall when the external threads of the retaining body are threaded into the internal threads of the fitting;

a sealing member disposed between the first annular flange and the tub wall;

a removable test plug traversing the axial bore adjacent the first annular flange; and a handle member attached to the test plug and projecting away from the aperture into the tub.

2. The tub overflow waste assembly of claim 1 wherein the retaining body is molded from a polymeric material.

3. The tub overflow waste assembly of claim 2 wherein the test plug is unitarily molded with the retaining body.

4. The tub overflow waste assembly of claim 3 wherein the handle member is unitarily molded with the test plug.

5. The tub overflow waste assembly of claim 2 wherein the handle member is unitarily molded with the test plug.

6. The tub overflow waste assembly of claim 2 wherein the retaining body is made of acrylonitrile butadiene styrene terpolymer.

7. The tub overflow waste assembly of claim 1 wherein the pipe fitting is molded from a polymeric material.

8. The tub overflow waste assembly of claim 1 wherein a plurality of circumferentially spaced fulcrum members project forwardly of the second annular flange.

9. The tub overflow waste assembly of claim 8 wherein the fulcrum members are diametrically opposed.

10. The tub overflow waste assembly of claim 8 wherein the fulcrum members have curvilinear surfaces.

11. The tub overflow waste assembly of claim 1 wherein the test plug is a knock-out plug.

12. The tub overflow waste assembly of claim 1 wherein the handle member comprises at least one axially projecting stem and at least two radially projecting wings.

13. The tub overflow waste assembly of claim 1 wherein the sealing member further comprises an annular polymeric washer having a second bore coaxially aligned with the bore through the threaded cylindrical member, the second bore having a diameter slightly greater than that of the threaded, substantially cylindrical member of the retaining body, the annular washer further comprising an interiorly facing, chamfered surface cooperatively alignable with the inclined surface of the first annular flange to create abutting contact therebetween upon full insertion of the threaded cylindrical member into the washer bore, the annular washer also having an annular gasket seating surface facing the tub wall around the aperture; and an interior tub gasket cooperatively alignable with the annular gasket seating surface of the annular washer.

14. The tub overflow waste assembly of claim 13 wherein the annular washer comprises a cylindrical collar member having an inside wall defining the second bore and an outside wall that is locatable within the aperture.

15. The tub overflow waste assembly of claim 13 wherein the polymeric washer is made of polypropylene.

16. The tub overflow waste assembly of claim 13 wherein the interior tub gasket is made of a compressible polymeric material.

17. The tub overflow waste assembly of claim 1 wherein the retaining body further comprises a plurality of circumferentially spaced lugs projecting outwardly from the first annular flange member and away from the tub wall.

18. The tub overflow waste assembly of claim 1 wherein the retaining body comprises an annular recess between the threads and the first annular flange.

19. The tub overflow waste assembly of claim 18, further comprising a sealing ring disposed in the annular recess.

20. A tub overflow waste assembly attachable to an internally threaded drain pipe fitting through an aperture in a tub wall, the assembly comprising;

a retaining body insertable through the aperture, the retaining body having an oxal bore and a cylindrical wall with external threads and a first annular flange disposed inwardly of the tub wall, the external threads being cooperatively aligned and reversibly engageable with the drain pipe fitting;

wherein the retaining body further comprises an annular recess between the external threads and the first annular flange and a sealing ring disposed in the annular recess;

a sealing member disposed between the first annular flange and the tub wall;

a removable test plug traversing the axial bore adjacent the first annular flange; and a handle member attached to the test plug and projecting away from the aperture and into the tub.

21. The tub overflow waste assembly of claim 20 wherein the retaining body is molded from a polymeric material.

22. The tub overflow waste assembly of claim 21 wherein the test plug is unitarily molded with the retaining body.

23. The tub overflow waste assembly of claim 22 wherein the handle member is unitarily molded with the test plug.

24. The tub overflow waste assembly of claim 21 wherein the handle member is unitarily molded with the test plug.

25. The tub overflow waste assembly of claim 20 wherein the pipe fitting is molded from a polymeric material.

26. The tub overflow waste assembly of claim 20 wherein the test plug is a knock-out plug.

27. The tub overflow waste assembly of claim 20 wherein the handle member comprises at least one axially projecting stem and at least two radially projecting wings.

* * * * *

UNITED STATES PATENT AND TRADEMARK OFFICE

CERTIFICATE OF CORRECTION

PATENT NO. : 6,289,532 B1
DATED : September 18, 2001
INVENTOR(S) : Kurt M. Fritz et al.

It is certified that error appears in the above-identified patent and that said Letters Patent is hereby corrected as shown below:

Column 7
Line 14, replace "oxal" with -- axial --.

Signed and Sealed this

Twenty-sixth Day of March, 2002

*Attest:*

*Attesting Officer*

JAMES E. ROGAN
*Director of the United States Patent and Trademark Office*